US007234326B1

(12) United States Patent
Lu

(10) Patent No.: US 7,234,326 B1
(45) Date of Patent: Jun. 26, 2007

(54) LOCK DEVICE

(75) Inventor: Francisco Lu, Kansan (TW)

(73) Assignee: Miz Engineering Ltd. (TW)

( * ) Notice: Subject to any disclaimer, the term of this patent is extended or adjusted under 35 U.S.C. 154(b) by 0 days.

(21) Appl. No.: 11/515,003

(22) Filed: Sep. 5, 2006

(30) Foreign Application Priority Data

Jun. 5, 2006 (TW) ..... 95119878 A

(51) Int. Cl.
*E05B 69/00* (2006.01)

(52) U.S. Cl. ..... 70/58; 70/14; 70/57; 70/428

(58) Field of Classification Search ..... 70/14, 70/18, 30, 49, 57, 58, 423–428; 248/551–553
See application file for complete search history.

(56) References Cited

U.S. PATENT DOCUMENTS

| | | | | | |
|---|---|---|---|---|---|
| 170,701 | A * | 12/1875 | Bechmann | 70/424 |
| 505,299 | A * | 9/1893 | Schneider | 70/428 |
| 881,364 | A * | 3/1908 | Wheeler | 70/424 |
| 942,537 | A * | 12/1909 | Batdorf | 70/426 |
| 1,101,450 | A * | 6/1914 | Kerry | 70/424 |
| 1,432,546 | A * | 10/1922 | Gillom | 70/424 |
| 1,470,937 | A * | 10/1923 | Schou | 70/428 |
| 1,713,602 | A * | 5/1929 | Heiden | 70/428 |
| 2,559,549 | A * | 7/1951 | Sevcik | 70/428 |
| 2,577,956 | A * | 12/1951 | Elsberg | 70/424 |
| 5,791,171 | A * | 8/1998 | Kelley | 70/58 |
| 6,000,251 | A * | 12/1999 | Murray et al. | 70/58 |
| 6,006,557 | A * | 12/1999 | Carl et al. | 70/58 |
| 6,038,891 | A * | 3/2000 | Zeren et al. | 70/58 |
| 6,058,744 | A * | 5/2000 | Ling | 70/28 |
| 6,257,029 | B1 * | 7/2001 | Liao | 70/58 |
| 6,305,199 | B1 * | 10/2001 | Igelmund | 70/58 |
| 6,401,502 | B1 * | 6/2002 | Yang | 70/30 |
| 6,523,373 | B1 * | 2/2003 | Su | 70/58 |
| 6,601,416 | B1 * | 8/2003 | Sanders | 70/58 |
| 6,619,081 | B1 * | 9/2003 | Yu | 70/58 |
| 6,672,117 | B2 * | 1/2004 | Yu | 70/58 |
| 6,708,535 | B1 * | 3/2004 | Sanders | 70/58 |
| 6,880,373 | B2 * | 4/2005 | Ling | 70/58 |
| 6,968,716 | B1 * | 11/2005 | Ling | 70/14 |
| 2003/0106349 | A1 * | 6/2003 | Broadbridge et al. | 70/58 |

* cited by examiner

*Primary Examiner*—Suzanne Dino Barrett
(74) *Attorney, Agent, or Firm*—Davidson Berquist Jackson & Gowdey LLP

(57) ABSTRACT

A lock device includes a lock housing unit, a jaw actuating unit, and a jaw unit. The lock housing unit includes an upper lock housing formed with a rod hole, and a lower lock housing formed with a jaw hole. The jaw actuating unit includes a jaw actuator operable to move between locking and unlocking positions, and an urging member for urging the jaw actuator to the locking position. The jaw actuator has a ring portion disposed adjacent to a positioning ring of the upper lock housing, and an operating rod extending through the rod hole. The jaw unit includes an overlapping pair of locking jaws received in the lower lock housing and each having a hooking section that extends out of the jaw hole and an opposite force bearing section, and two biasing members for biasing the force bearing sections of the locking jaws toward each other.

11 Claims, 5 Drawing Sheets

LOCK DEVICE

CROSS-REFERENCE TO RELATED APPLICATION

This application claims priority of Taiwanese application no. 095119878, filed on Jun. 5, 2006.

BACKGROUND OF THE INVENTION

1. Field of the Invention

The invention relates to a lock device, more particularly to a lock device suitable for use when locking a number of hardware devices together.

2. Description of the Related Art

In order to prevent theft of expensive peripheral hardware devices or products, manufacturers usually form such devices with a lock hole for mounting of a lock assembly, which includes a locking chain that can be tied to a fixed object.

However, since the conventional lock assembly is designed for application to only one hardware device, several lock assemblies are required when protecting a corresponding number of the hardware devices from theft. In view of the cost of each lock assembly, which includes a lock body, a locking chain and a key, high expenses are incurred when protecting a large number of the hardware devices from theft. Moreover, it is both troublesome and inconvenient to manage or handle individual keys of a large number of the lock assemblies. In addition, tying the locking chains of a number of the lock assemblies to the same fixed object results in an untidy environment.

SUMMARY OF THE INVENTION

Therefore, the object of the present invention is to provide a lock device that is suitable for use when locking a number of objects together to protect the objects from theft.

Accordingly, a lock device of the present invention is adapted for use with an object having a lock hole, and comprises a lock housing unit, a jaw actuating unit and a jaw unit.

The lock housing unit includes an upper lock housing and a lower lock housing. The upper lock housing has a coupling part that is formed with a rod hole, and at least one positioning ring that extends outwardly from the coupling part. The lower lock housing has a first end part coupled to the coupling part of the upper lock housing, and a second end part formed with a jaw hole.

The jaw actuating unit includes a jaw actuator and an urging member. The jaw actuator is operable to move relative to the lock housing unit between locking and unlocking positions, and has a ring portion that is disposed adjacent to the positioning ring of the upper lock housing, and an operating rod that extends from the ring portion and through the rod hole in the upper lock housing. The urging member urges the jaw actuator to the locking position.

The jaw unit includes an overlapping pair of locking jaws received in the lower lock housing, and a pair of biasing members. The locking jaws are pivoted to each other and to the lower lock housing. Each of the locking jaws has a hooking section that extends out of the jaw hole in the lower lock housing and that is extendible into the lock hole to engage a periphery of the lock hole, and a force bearing section opposite to the hooking section. The biasing members bias the force bearing sections of the locking jaws toward each other.

The positioning ring and the ring portion are misaligned, and the operating rod permits movement of the force bearing sections of the locking jaws toward each other by virtue of biasing action of the biasing members when the jaw actuator is at the unlocking position, thereby forcing the hooking sections of the locking jaws toward each other such that the hooking sections of the locking jaws can be extended into and removed from the lock hole and are unable to engage the periphery of the lock hole.

The ring portion is aligned with the positioning ring, and the operating rod extends between and forces apart the force bearing sections of the locking jaws when the jaw actuator is at the locking position, thereby forcing the hooking sections of the locking jaws apart from each other such that the hooking sections of the locking jaws are capable of engaging the periphery of the lock hole when extended into the lock hole.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
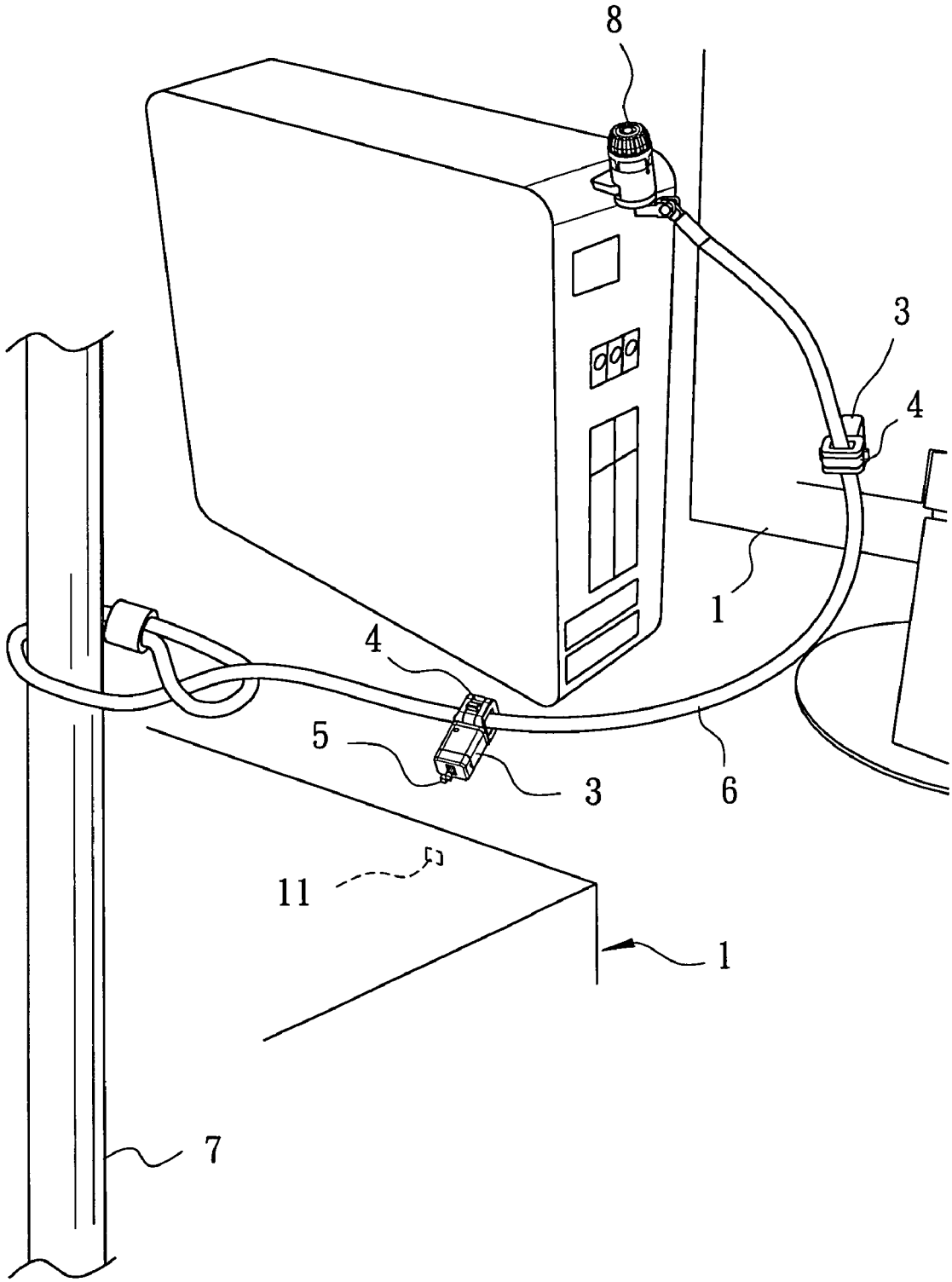
FIG. 1 is a perspective view to illustrate a pair of lock devices according to the present invention in a state of use.
Figure 2:
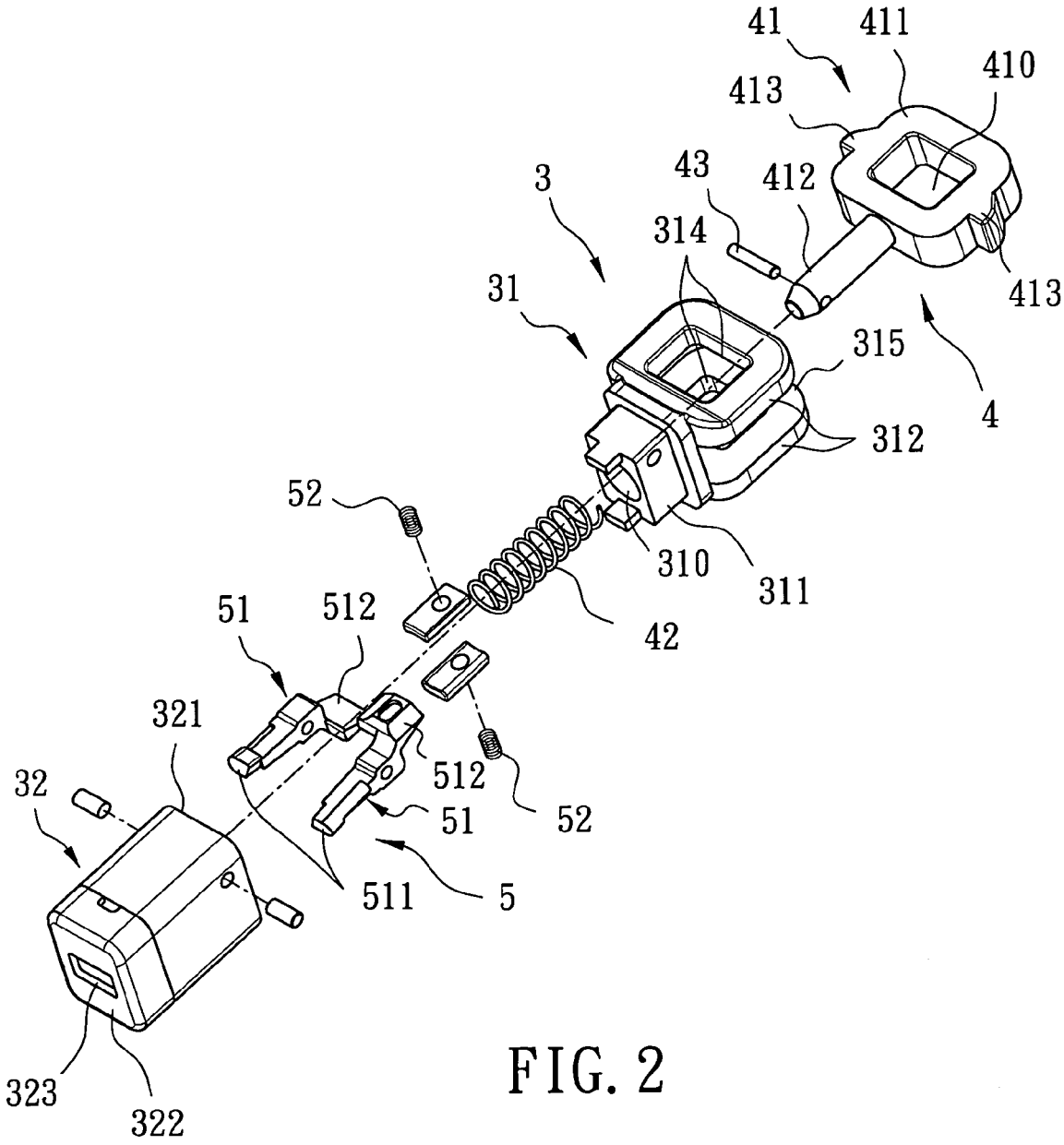
FIG. 2 is an exploded perspective view of the preferred embodiment of a lock device according to this invention.
Figure 3:
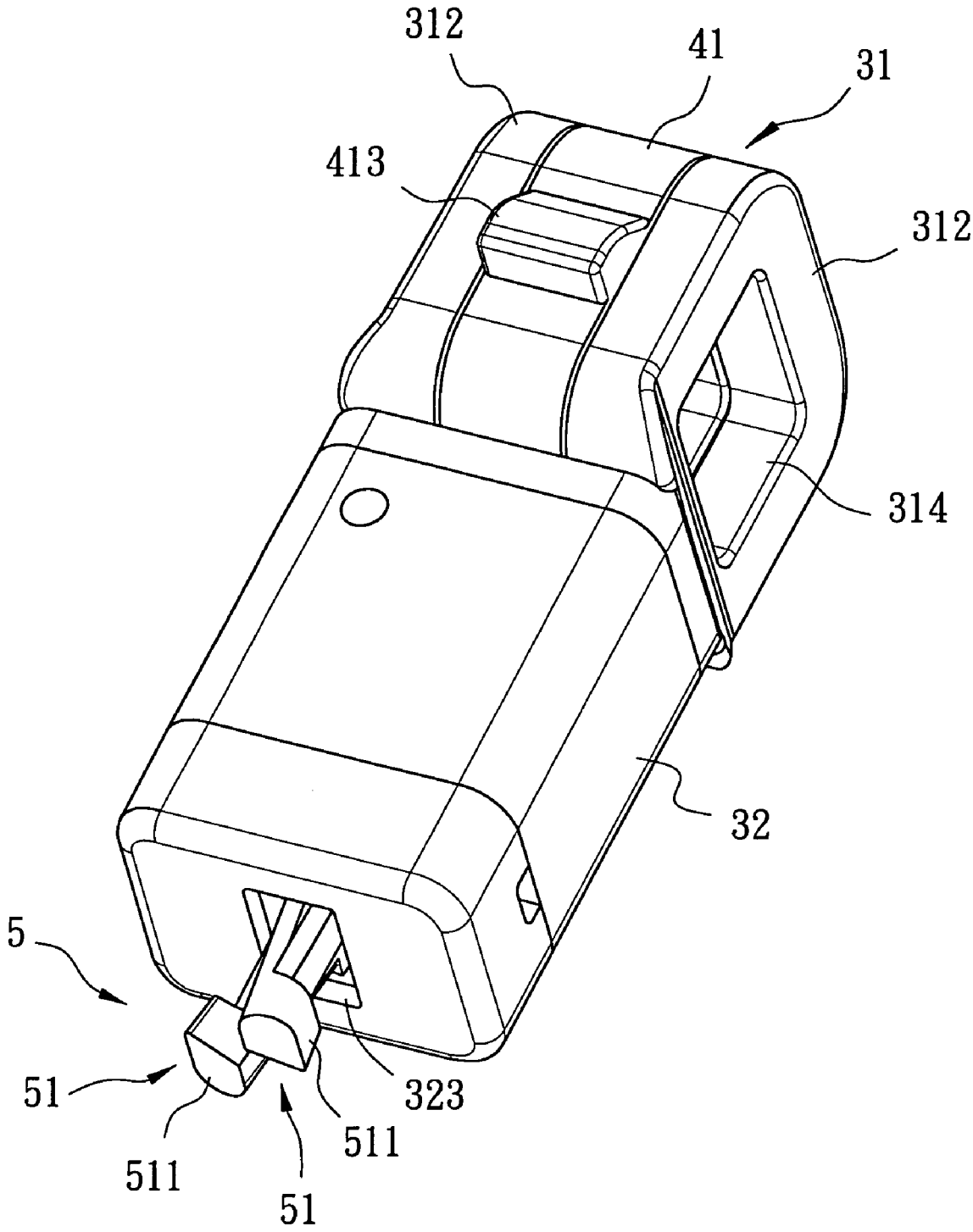
FIG. 3 is an assembled perspective view of the preferred embodiment.

As shown in FIGS. 1, 2 and 3, the preferred embodiment of a lock device according to the present invention is shown to be adapted for use with an object 1 having a lock hole 11. The object 1 can be an electronic device, such as a liquid crystal display, a desktop computer, a notebook computer, a printer, a projector, a digital camera, etc.

The lock device comprises a lock housing unit 3, a jaw actuating unit 4, and a jaw unit 5.

The lock housing unit 3 includes an upper lock housing 31 and a lower lock housing 32. The upper lock housing 31 has a coupling part 311 that is formed with a rod hole 310, and a pair of positioning rings 312 that are spaced apart from each other and that extend outwardly from the coupling part 311. The coupling part 311 of the upper lock housing 31 is formed with a shoulder 313 (see FIGS. 4 and 5) that projects in radial inward directions in the rod hole 310. The positioning rings 312 are each formed with a ring hole 314, and cooperate to confine a gap 315 therebetween.

The lower lock housing 32 has a first end part 321 that is coupled to the coupling part 311 of the upper lock housing 31, and a second end part 322 that is opposite to the first end part 321 and that is formed with a jaw hole 323. In this embodiment, the first end part 321 is sleeved fittingly on the coupling part 311.

Figure 4:
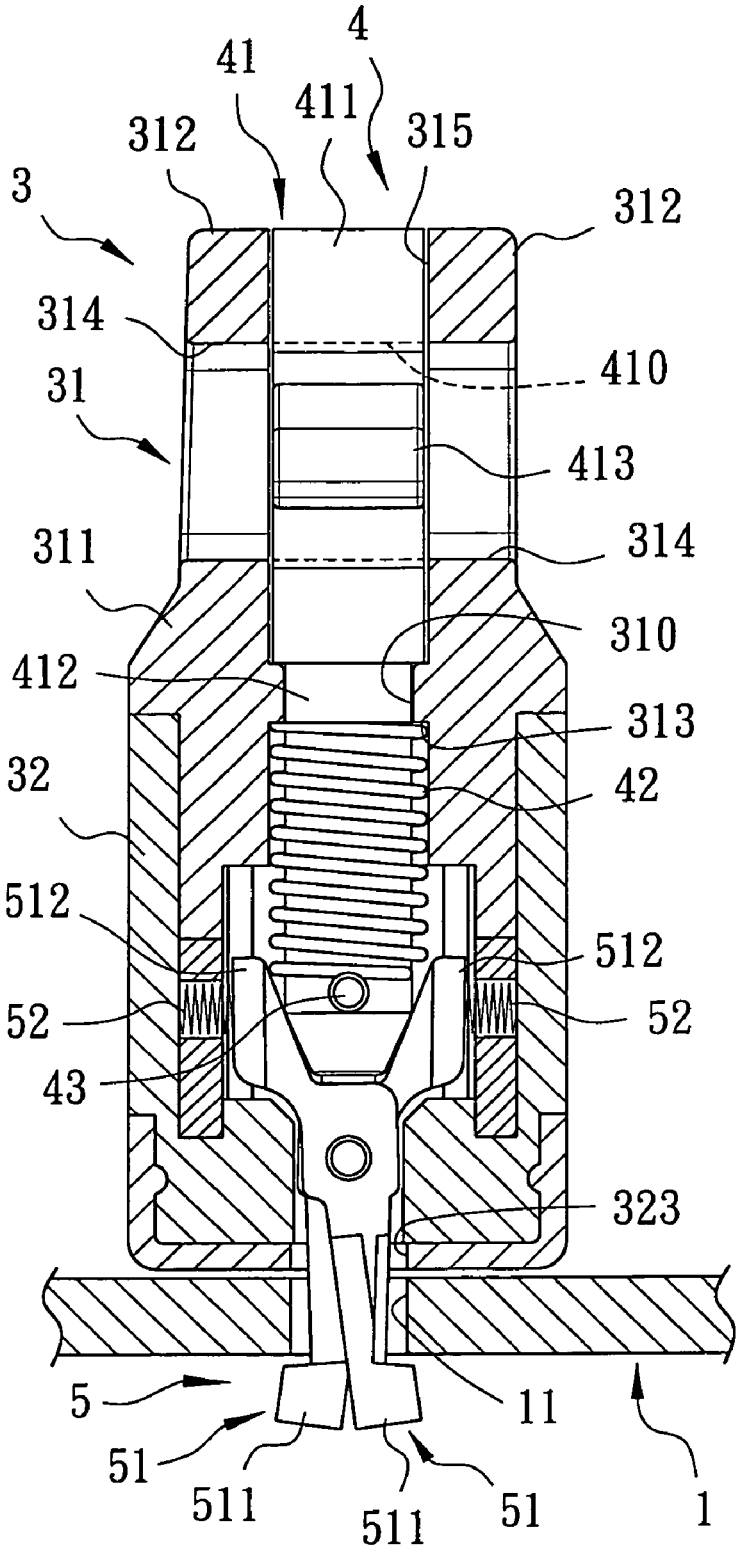
FIG. 4 is a sectional view of the preferred embodiment, illustrating a jaw actuator thereof at a locking position.

The jaw actuating unit 4 includes a jaw actuator 41 and an urging member 42. The jaw actuator 41 is operable to move relative to the lock housing unit 3 between locking and unlocking positions (see FIGS. 4 and 5), and has a ring portion 411 that is disposed in the gap 315 confined between the positioning rings 312 of the upper lock housing 31, and an operating rod 412 that extends from the ring portion 411 and through the rod hole 310 in the upper lock housing 31. The ring portion 411 is formed with a ring hole 410 that is aligned with the ring holes 314 of the positioning rings 312 when the jaw actuator 41 is at the locking position, as best shown in FIG. 4. In this embodiment, the operating rod 412 has a frustoconical distal end part. The jaw actuating unit 4 further includes a supporting pin 43 that extends radially through the operating rod 412 adjacent to the distal end part of the same. The urging member 42 urges the jaw actuator 41 to the locking position, is sleeved on the operating rod 412, and has opposite ends that abut against the shoulder 313 and the supporting pin 43, respectively. The urging member 42 is a compression spring in this embodiment. The jaw actuator 41 further has two operating protrusions 413 that project outwardly and respectively from opposite lateral sides of the ring portion 411 and that are accessible externally of the upper lock housing 31. The operating protrusions 413 facilitate pulling of the jaw actuator 41 from the locking position to the unlocking position. In practice, the jaw actuator 41 may be provided with only one operating protrusion 413.

The jaw unit 5 includes an overlapping pair of locking jaws 51 received in the lower lock housing 32, and a pair of biasing members 52. The locking jaws 51 are pivoted to each other and to the lower lock housing 32. Each of the locking jaws 51 has a hooking section 511 that extends out of the jaw hole 323 in the lower lock housing 32 and that is extendible into the lock hole 11 to engage a periphery of the lock hole 11, and a force bearing section 512 that is opposite to the hooking section 511. The biasing members 52 bias the force bearing sections 512 of the locking jaws 51 toward each other. In this embodiment, each of the biasing members 52 is a compression spring having one end abutting against the lower lock housing 32 and an opposite end abutting against the force bearing section 512 of a respective one of the locking jaws 51.

Figure 5:
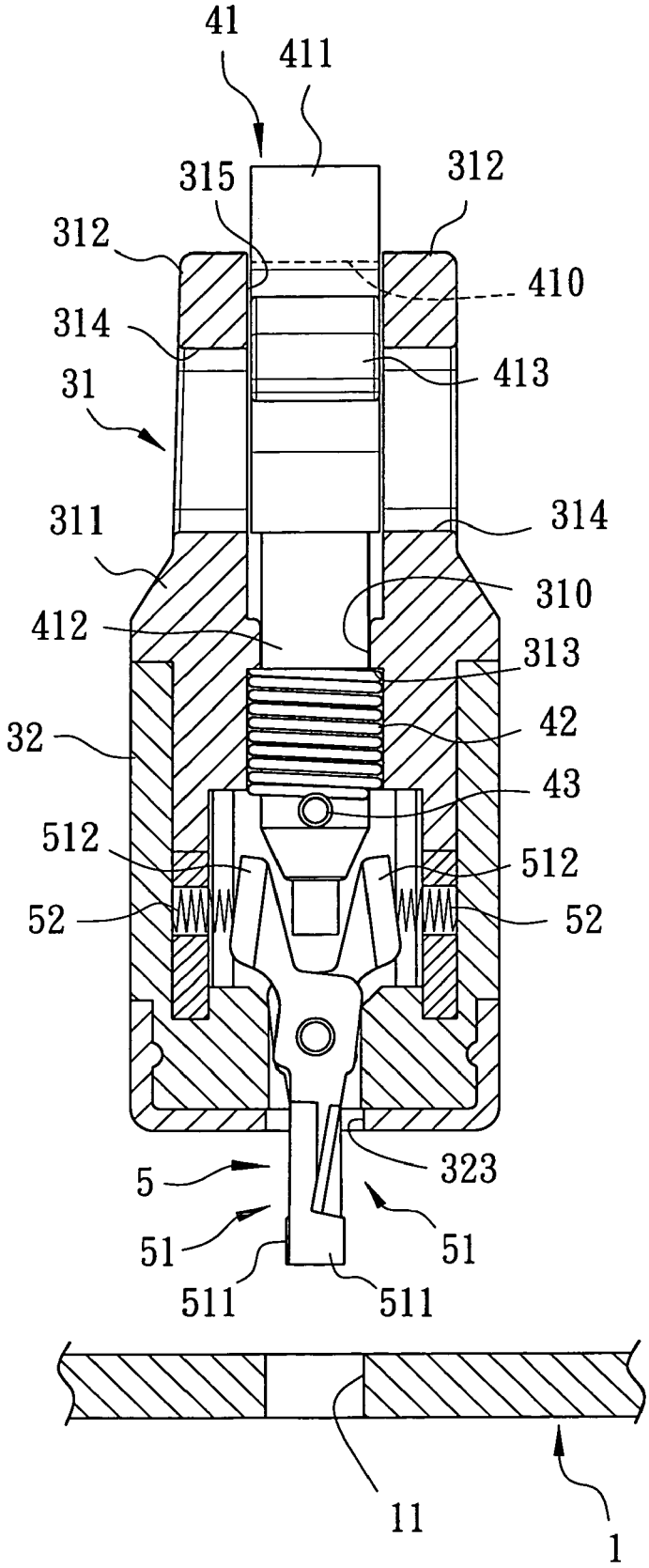
FIG. 5 is a sectional view of the preferred embodiment, illustrating the jaw actuator at an unlocking position.

As shown in FIG. 5, the positioning rings 312 of the upper lock housing 31 of the lock housing unit 3 and the ring portion 411 of the jaw actuator 41 of the jaw actuating unit 4 are misaligned, and the operating rod 412 of the jaw actuator 41 permits movement of the force bearing sections 512 of the locking jaws 51 of the jaw unit 5 toward each other by virtue of biasing action of the biasing members 52 when the jaw actuator 41 is pulled to the unlocking position, thereby forcing the hooking sections 511 of the locking jaws 51 toward each other such that the hooking sections 511 of the locking jaws 51 can be extended into and removed from the lock hole 11 and are unable to engage the periphery of the lock hole 11.

On the other hand, as shown in FIG. 4, the ring portion 411 of the jaw actuator 41 is aligned with the positioning rings 312 of the upper lock housing 31, and the distal end part of the operating rod 412 extends between and forces apart the force bearing sections 512 of the locking jaws 51 against the biasing action of the biasing members 52 when the jaw actuator 41 is biased by the urging member 42 to the locking position, thereby forcing the hooking sections 511 of the locking jaws 51 apart from each other such that the hooking sections 511 of the locking jaws 51 are capable of engaging the periphery of the lock hole 11 when extended into the lock hole 11.

Therefore, to use the lock device of this invention, the jaw actuator 41 of the jaw actuating unit 4 is first pulled to the unlocking position to permit extension of the hooking sections 511 of the locking jaws 51 of the jaw unit 5 into the lock hole 11 in the object 1. The jaw actuator 41 is then released and is automatically restored to the locking position by the urging member 42. At this time, the hooking sections 511 of the locking jaws 51 engage the periphery of the lock hole 11, thereby mounting the lock device on the object 1.

To protect a number of the objects 1, each mounted with the lock device of this invention, from theft, a lock body 8 of a conventional lock assembly is first mounted on another object, and a locking chain 6 of the conventional lock assembly is passed through the ring holes 314, 410 in the upper lock housing 31 and the jaw actuator 41 of each of the lock devices on the objects 1. One end of the locking chain 6 is then tied to a fixture 7, such as a post.

It is noted that the diameter of the locking chain 6 is designed to be slightly smaller than the ring holes 314, 410 so that, after the locking chain 6 has been extended through the ring holes 314, 410, there is insufficient room for the jaw actuator 41 to move from the locking position to the unlocking position. As a result, the objects 1 are locked together to protect the same from theft.

In sum, the lock device of this invention can be used with a conventional lock assembly so that it is possible to lock a number of objects 1 using the locking chain 6 of a single conventional lock assembly.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lock device adapted for use with an object having a lock hole, said lock device comprising:

a lock housing unit including an upper lock housing having a coupling part that is formed with a rod hole, and at least one positioning ring that extends outwardly from said coupling part, and a lower lock housing having a first end part coupled to said coupling part of said upper lock housing, and a second end part formed with a jaw hole;

a jaw actuating unit including a jaw actuator operable to move relative to said lock housing unit between locking and unlocking positions, said jaw actuator having a ring portion that is disposed adjacent to said positioning ring of said upper lock housing, and an operating rod that extends from said ring portion and through said rod hole in said upper lock housing, and an urging member for urging said jaw actuator to the locking position; and a jaw unit including an overlapping pair of locking jaws received in said lower lock housing, said locking jaws being pivoted to each other and to said lower lock housing, each of said locking jaws having a hooking section that extends out of said jaw hole in said lower lock housing and that is extendible into the lock hole to engage a periphery of the lock hole, and a force bearing section opposite to said hooking section, and a pair of biasing members for biasing said force bearing sections of said locking jaws toward each other;

wherein said positioning ring and said ring portion are misaligned and said operating rod permits movement of said force bearing sections of said locking jaws toward each other by virtue of biasing action of said biasing members when said jaw actuator is at the unlocking position, thereby forcing said hooking sections of said locking jaws toward each other such that said hooking sections of said locking jaws can be extended into and removed from the lock hole and are unable to engage the periphery of the lock hole; and wherein said ring portion is aligned with said positioning ring and said operating rod extends between and forces apart said force bearing sections of said locking jaws when said jaw actuator is at the locking position, thereby forcing said hooking sections of said locking jaws apart from each other such that said hooking sections of said locking jaws are capable of engaging the periphery of the lock hole when extended into the lock hole.

2. The lock device as claimed in claim 1, wherein said coupling part of said upper lock housing is formed with a shoulder that projects in radial inward directions in said rod hole, said jaw actuating unit further including a supporting pin that extends radially through said operating rod, said urging member being sleeved on said operating rod and having opposite ends that abut against said shoulder and said supporting pin, respectively.

3. The lock device as claimed in claim 1, wherein said upper lock housing has a pair of said positioning rings that are spaced apart from each other, said ring portion of said jaw actuator being confined between said positioning rings.

4. The lock device as claimed in claim 1, wherein said jaw actuator further has at least one operating protrusion that projects outwardly from said ring portion and that is accessible externally of said upper lock housing.

5. The lock device as claimed in claim 1, wherein said urging member is a compression spring.

6. The lock device as claimed in claim 1, wherein each of said biasing members is a compression spring having one end abutting against said lower lock housing and an opposite end abutting against said force bearing section of a respective one of said locking jaws.

7. The lock device as claimed in claim 2, wherein said upper lock housing has a pair of said positioning rings that are spaced apart from each other, said ring portion of said jaw actuator being confined between said positioning rings.

8. The lock device as claimed in claim 7, wherein said jaw actuator further has at least one operating protrusion that projects outwardly from said ring body and that is accessible externally of said upper lock housing.

9. The lock device as claimed in claim 8, wherein said urging member is a compression spring.

10. The lock device as claimed in claim 9, wherein each of said biasing members is a compression spring having one end abutting against said lower lock housing and an opposite end abutting against said force bearing section of a respective one of said locking jaws.

11. The lock device as claimed in claim 10, wherein said operating rod has a frustoconical distal end part.

* * * * *